US010265767B2

(12) United States Patent
Sawada

(10) Patent No.: US 10,265,767 B2
(45) Date of Patent: Apr. 23, 2019

(54) ALLOY POWDER, AND SHOT MATERIAL FOR SHOT PEENING, POWDER METALLURGICAL COMPOSITION AND IRON-BASED SINTERED ALLOY USING THE SAME

(71) Applicant: Sanyo Special Steel Co., Ltd., Himeji-shi (JP)

(72) Inventor: Toshiyuki Sawada, Himeji (JP)

(73) Assignee: Sanyo Special Steel Co., Ltd., Himeji-shi (JP)

( * ) Notice: Subject to any disclaimer, the term of this patent is extended or adjusted under 35 U.S.C. 154(b) by 406 days.

(21) Appl. No.: 15/164,018

(22) Filed: May 25, 2016

(65) Prior Publication Data

US 2016/0346837 A1 Dec. 1, 2016

(30) Foreign Application Priority Data

May 26, 2015 (JP) ..... 2015-106261

(51) Int. Cl.

| | |
|---|---|
| ***B22F 3/00*** | (2006.01) |
| ***B22F 1/00*** | (2006.01) |
| ***C22C 38/58*** | (2006.01) |
| ***C22C 38/56*** | (2006.01) |
| ***C22C 38/52*** | (2006.01) |
| ***C22C 38/48*** | (2006.01) |
| ***C22C 38/46*** | (2006.01) |
| ***C22C 38/44*** | (2006.01) |
| ***C22C 38/38*** | (2006.01) |
| ***C22C 38/36*** | (2006.01) |
| ***C22C 38/30*** | (2006.01) |
| ***C22C 38/26*** | (2006.01) |
| ***C22C 38/24*** | (2006.01) |
| ***C22C 38/22*** | (2006.01) |
| ***C22C 38/04*** | (2006.01) |
| ***C22C 38/02*** | (2006.01) |
| ***B22F 9/08*** | (2006.01) |
| ***C22C 33/02*** | (2006.01) |
| ***C22C 27/06*** | (2006.01) |
| *B22F 3/02* | (2006.01) |

(52) U.S. Cl.

CPC ..... *B22F 1/0003* (2013.01); *B22F 9/082* (2013.01); *C22C 27/06* (2013.01); *C22C 33/0285* (2013.01); *C22C 38/02* (2013.01); *C22C 38/04* (2013.01); *C22C 38/22* (2013.01); *C22C 38/24* (2013.01); *C22C 38/26* (2013.01); *C22C 38/30* (2013.01); *C22C 38/36* (2013.01); *C22C 38/38* (2013.01); *C22C 38/44* (2013.01); *C22C 38/46* (2013.01); *C22C 38/48* (2013.01); *C22C 38/52* (2013.01); *C22C 38/56* (2013.01); *C22C 38/58* (2013.01); *B22F 2003/023* (2013.01); *B22F 2009/0828* (2013.01); *B22F 2998/10* (2013.01); *B22F 2999/00* (2013.01)

(58) Field of Classification Search

CPC ..... B22F 1/0003; C22C 38/58
USPC ..... 75/255
See application file for complete search history.

(56) References Cited

U.S. PATENT DOCUMENTS

| | | | | |
|---|---|---|---|---|
| 2011/0146448 | A1 | 6/2011 | Fujitsuka et al. | |
| 2012/0177528 | A1* | 7/2012 | Takayama ..... | B22F 3/10 419/38 |

FOREIGN PATENT DOCUMENTS

| | | | |
|---|---|---|---|
| JP | 4815711 | A | 2/1973 |
| JP | 4500840 | A | 2/1992 |
| JP | 860287 | A | 3/1996 |
| JP | 200784858 | A | 4/2007 |
| JP | 2010222661 | A | 10/2010 |
| JP | 2011149088 | A | 8/2011 |
| JP | 2013193199 | A | 9/2013 |
| WO | 9102101 | A1 | 2/1991 |

* cited by examiner

*Primary Examiner* — Weiping Zhu
(74) *Attorney, Agent, or Firm* — The Webb Law Firm

(57) ABSTRACT

It is an object of the present invention to provide an alloy powder that has high hardness and high corrosion resistance and can be produced from inexpensive raw materials, as well as to provide a shot material for shot peening, a powder metallurgical composition, and an iron-based sintered alloy using the alloy powder, and, in order to achieve such an object, there are provided an alloy powder including, in mass %, C: 0.6% or more and 2.4% or less,
Cr: 36% or more and 60% or less,
Mn: 0.1% or more and 10% or less,
Mo: 0% or more and 10% or less,
Si: 0% or more and less than 2%,
Ni: 0% or more and 15% or less,
Co: 0% or more and 5% or less,
W: 0% or more and 5% or less,
V: 0% or more and 5% or less,
Nb: 0% or more and 5% or less, and
the balance of Fe and unavoidable impurities, as well as the shot material for shot peening, the powder metallurgical composition, and the iron-based sintered alloy using the alloy powder.

14 Claims, No Drawings

ALLOY POWDER, AND SHOT MATERIAL FOR SHOT PEENING, POWDER METALLURGICAL COMPOSITION AND IRON-BASED SINTERED ALLOY USING THE SAME

CROSS-REFERENCE TO RELATED APPLICATIONS

This application is based upon and claims the benefit of priority from Japanese Patent Application No. 2015-106261 filed on May 26, 2015; the entire contents of which are incorporated herein by reference.

BACKGROUND OF THE INVENTION

Field of the Invention

The present invention relates to an alloy powder, as well as a shot material for shot peening, a powder metallurgical composition, and an iron-based sintered alloy using the alloy powder.

Background Art

Shot peening is a method for treating a surface of a material to be treated by projecting particles referred to as a projecting material (or also referred to as "shot", "shot material", "medium", "polishing material", or the like) onto a surface of the material to be treated. The shot peening is applied to automobile components such as springs and gears, metal mold materials, and the like because the shot peening is effective at applying compressive residual stress to the material to be treated and at improving the fatigue strength of the material to be treated. In general, however, high compressive residual stress is not obtained when a material to be treated having high surface hardness is subjected to shot peening using a shot material having low hardness. In addition, with the further need for reduction in the weight of an automobile component or the like, it is necessary to perform shot peening Therefore, a shot material having further high hardness is needed.

A technology for increasing the hardness of such a shot material for shot peening is proposed in, for example, Japanese Patent Laid-Open Publication No. 2007-84858 (PTL 1). The shot material according to PTL 1 comprises $Fe_2B$ as a hard phase, resulting in high hardness, and comprises 25% or less of Cr, resulting in corrosion resistance at the level of which rust is prevented in atmospheric air. However, a material to be treated may be subjected to shot peening while being wet with water (for example, tap water). In such a case, a shot material used for the shot peening also gets wet with water (for example, tap water). Typically, a shot material wet with water is dried (for example, naturally dried) and reused for shot peening. However, the shot material according to PTL 1 may rust in a period from the state of wetting with water to being dried, and the corrosion resistance of the shot material is not necessarily sufficient.

An abrasion-resistant iron-based sintered alloy comprising an iron-based alloy matrix and a hard phase scattered in the iron-based alloy matrix is used in a valve guide or a valve seat. Such an abrasion-resistant iron-based sintered alloy is produced by mixing an iron-based powder, a hard-phase forming powder, and optionally another powder (for example, graphite powder), molding the mixed powder, and sintering the molded body. Hard particles used as the hard-phase forming powder are classified broadly into Co-based hard particles and Fe-based hard particles. For example, Co—Mo—Si-based hard particles as the Co-based hard particles and Fe—Cr—C-based or Fe—Mo—Si-based hard particles as the Fe-based hard particles are often used as disclosed in Japanese Patent Laid-Open Publication No. 2011-149088 (PTL 2). Co—Mo—Si-based and Fe—Mo—Si-based hard particles comprise a Laves phase as a hard phase. Therefore, the high hardness of the hard particles can be maintained even when the hard particles are heat-treated at high temperature in a sintering step. Accordingly, a hard phase effective at improving the abrasion resistance of the iron-based sintered alloy can be formed when the Co—Mo—Si-based or Fe—Mo—Si-based hard particles are used as the hard-phase forming powder. However, heat treatment of Fe—Cr—C-based hard particles at high temperature in a sintering step tends to result in a prominent decrease in hardness. Accordingly, it may be impossible to form a hard phase effective at improving the abrasion resistance of the iron-based sintered alloy when the Fe—Cr—C-based hard particles are used as the hard-phase forming powder. Further, the Co—Mo—Si-based and Fe—Mo—Si-based hard particles comprise a large amount of expensive Mo and therefore have higher costs.

CITATION LIST

Patent Literature

[PTL 1] Japanese Patent Laid-Open Publication No. 2007-84858

[PTL 2] Japanese Patent Laid-Open Publication No. 2011-149088

SUMMARY OF THE INVENTION

When the shot material for shot peening according to PTL 1 is used in an environment including water, the shot material may rust in a period from the state of wetting under water to being dried. Thus, the corrosion resistance of the shot material is not necessarily sufficient. When the Fe—Cr—C-based hard particles according to PTL 2 are heat-treated in a sintering step, it may be impossible to maintain high hardness and to form a hard phase effective at improving the abrasion resistance of an iron-based sintered alloy. Further, the Co—Mo—Si-based and Fe—Mo—Si-based hard particles comprise a large amount of expensive Mo and therefore have higher costs.

It is therefore an object of the present invention to provide an alloy powder that has high hardness and high corrosion resistance and can be produced from inexpensive raw materials, as well as to provide a shot material for shot peening, a powder metallurgical composition, and an iron-based sintered alloy using the alloy powder.

In order to solve the above-described problems, the present invention is to provide an alloy powder, a shot material for shot peening, a powder metallurgical composition, and an iron-based sintered alloy described below.

(1) An alloy powder, comprising, in mass %,

C: 0.6% or more and 2.4% or less,
Cr: 36% or more and 60% or less,
Mn: 0.1% or more and 10% or less,
Mo: 0% or more and 10% or less,
Si: 0% or more and less than 2%,
Ni: 0% or more and 15% or less,
Co: 0% or more and 5% or less,
W: 0% or more and 5% or less, V: 0% or more and 5% or less,
Nb: 0% or more and 5% or less, and
the balance of Fe and unavoidable impurities.

(2) The alloy powder according to (1), comprising, in mass %, one or more selected from Mo: 0.1% or more and 10% or less, Si: 0.1% or more and less than 2%, and Ni: 0.1% or more and 15% or less.

(3) The alloy powder according to (1), comprising, in mass %, one or more selected from Co: 0.1% or more and 5% or less, W: 0.1% or more and 5% or less, V: 0.1% or more and 5% or less, and Nb: 0.1% or more and 5% or less.

(4) The alloy powder according to (1), comprising, in mass %, one or more selected from Mo: 0.1% or more and 10% or less, Si: 0.1% or more and less than 2%, and Ni: 0.1% or more and 15% or less, and one or more selected from Co: 0.1% or more and 5% or less, W: 0.1% or more and 5% or less, V: 0.1% or more and 5% or less, and Nb: 0.1% or more and 5% or less.

(5) The alloy powder according to (1), wherein the alloy powder has an average particle diameter (D50) of 20 to 300 μm.

(6) The alloy powder according to (1), wherein the alloy powder has a Vickers hardness of 500 HV or more.

(7) The alloy powder according to (1), wherein the alloy powder has an average particle diameter (D50) of 20 to 300 μm and a Vickers hardness of 500 HV or more.

(8) A shot material for shot peening, comprising the alloy powder according to (1).

(9) A powder metallurgical composition, comprising an iron-based powder and the alloy powder according to (1).

(10) An iron-based sintered alloy obtained by sintering a molded body of the powder metallurgical composition according to (9).

According to the present invention, there is provided an alloy powder that has high hardness and high corrosion resistance and can be produced from inexpensive raw materials, as well as a shot material for shot peening, a powder metallurgical composition, and an iron-based sintered alloy using the alloy powder.

DETAILED DESCRIPTION OF THE INVENTION

The present invention will be specifically described below. Unless otherwise specified, "%" as used herein means mass %.

[Alloy Powder]

An alloy powder of the present invention is a powder of an alloy comprising, in mass %, C: 0.6% or more and 2.4% or less,
Cr: 36% or more and 60% or less,
Mn: 0.1% or more and 10% or less,
Mo: 0% or more and 10% or less,
Si: 0% or more and less than 2%,
Ni: 0% or more and 15% or less,
Co: 0% or more and 5% or less,
W: 0% or more and 5% or less,
V: 0% or more and 5% or less,
Nb: 0% or more and 5% or less, and
the balance of Fe and unavoidable impurities.

In other words, the alloy powder of the present invention is an aggregate of a large number of alloy particles, and each alloy particle comprises, in mass %, C: 0.6% or more and 2.4% or less,
Cr: 36% or more and 60% or less,
Mn: 0.1% or more and 10% or less,
Mo: 0% or more and 10% or less,
Si: 0% or more and less than 2%,
Ni: 0% or more and 15% or less,
Co: 0% or more and 5% or less,
W: 0% or more and 5% or less,
V: 0% or more and 5% or less,
Nb: 0% or more and 5% or less, and
the balance of Fe and unavoidable impurities.

In the alloy powder of the present invention, the content of Cr in the alloy particles is adjusted to 36% or more. Therefore, the alloy powder is prevented from rusting in a period from the state of wetting under water (for example, tap water) to being dried (for example, naturally dried). Further, the high hardness of the alloy powder is maintained even when the alloy powder is heat-treated at high temperature in a sintering step. Thus, a hard phase effective at improving the abrasion resistance of an iron-based sintered alloy can be formed. Accordingly, the alloy powder of the present invention is useful as hard particles (hard-phase forming powder) for a shot material for shot peening and for an abrasion-resistant iron-based sintered alloy. The alloy powder of the present invention can be efficiently produced by an atomization method such as a water atomization method or a gas atomization method. However, simple adjustment of a Cr content to 36% or more may result in clogging of a nozzle caused by the high viscosity of a molten alloy metal in an atomization step and in deterioration of productivity. In this regard, the alloy powder of the present invention enables a nozzle to be prevented from clogging in an atomization step because a Cr content is adjusted to 36% or more and 60% or less and a Mn content is adjusted to 0.1% or more and 10% or less in the alloy particles in the alloy powder of the present invention. When the alloy powder of the present invention is produced by a casting grinding method, a decrease in the viscosity of a molten alloy metal also has the effect of facilitating the casting.

Commonly, steel containing around 12% or more of Cr falls within the category of stainless steel and is considered to rarely rust even if wetting under water (for example, tap water). However, large distortion is introduced into a shot material simultaneously with the application of large distortion to a surface of a material to be treated by a collision between the material to be treated and the shot material in shot peening. By subjecting a so-called fine-particulate shot material having of a smaller diameter of around 20 to 300 μm than the diameter of a typical shot material for shot peening to shot peening at a projection air pressure equal to that in the cause of the typical shot material for shot peening, the flying rate of the fine-particulate shot material is significantly increased, resulting in introduction of larger distortion into a surface of a material to be treated and even in generation of nanocrystal grains. Accordingly, significantly large distortion is considered to be also introduced into the fine-particulate shot material. Such large distortion is presumed to cause even a fine-particulate shot material containing Cr of which the amount is equivalent to the level of Cr in stainless steel to rust when the fine-particulate shot material wets under water (for example, tap water).

In contrast, as a result of carrying out an experiment in which a shot material was used for shot peening, then wetted under water (tap water), and naturally dried, thereby simulating an environment in which the shot material can rust, and of intensively examining the influence of a Cr content on the behavior of the rusting as described in Examples later, the present inventors found for the first time that the rusting can be inhibited by adjusting the content of Cr in alloy particles to 36% or more.

This is considered to be because a firm passive film formed of Cr of which the concentration is higher than those in conventional passive films imparts resistance against an impact caused by shot peening and the passive film is formed or maintained even in the state of the presence of very high distortion introduced by shot peening. The alloy powder of the present invention can actualize a shot material that can endure a very special environment in which the shot material unavoidably wets under water (for example, tap water) and an impact and high distortion are unavoidably introduced into the shot material by shot peening, and that is totally different from conventional shot materials.

When Fe—Cr—C-based hard particles are used as hard particles (hard-phase forming powder) for an abrasion-resistant iron-based sintered alloy, a Cr-based carbide is primarily formed, whereby a hard phase effective at improving the abrasion resistance of an iron-based sintered alloy can be formed. A sintering temperature at which an abrasion-resistant iron-based sintered alloy used in a valve guide or a valve seat is produced is commonly 1000° C. or more. Higher density and higher abrasion resistance are achieved by sintering at a high temperature of around 1100° C. in a case in which higher abrasion resistance is demanded. However, sintering at such a high temperature results in the solid solution of a Cr-based carbide in a hard phase formed of Fe—Cr—C-based hard particles in the Fe-based matrix of the hard phase or in scattering of Cr and/or C in the iron-based matrix of a sintered alloy, whereby the hardness of the hard phase formed of the Fe—Cr—C-based hard particles may be decreased.

Ordinarily, a sintering temperature is unavoidably set at a low temperature or hard particles that contain a rare metal such as Mo or Co and generate a Laves phase are unavoidably selected at the expense of a cost in order to avoid such a decrease in the hardness of the hard phase. In contrast, as a result of intensively examining the influence of the content of Cr in hard particles on the hardness of a hard phase formed through sintering at a high temperature of around 1100° C. as described in Examples later, the present inventors found for the first time that the hard particles contain 36% or more of Cr, whereby the hard phase of which the sufficient hardness is maintained can be formed even if the hard particles do not contain any expensive rare metal.

Commonly, some of Cr atoms in a Cr-based carbide produced in a hard phase formed of Fe—Cr—C-based hard particles are replaced with Fe atoms. However, it is considered that an increase of a Cr content to 36% or more results in production of a Cr-based carbide in which a Fe-substitution amount is very low, and therefore results in enhancement of the thermal stability of the Cr-based carbide, in prevention of decomposition of the Cr-based carbide even in a case in which the Cr-based carbide is held at a high temperature, in inhibition of scattering of Cr and/or C in the iron-based matrix of a sintered alloy, and in formation of a hard phase of which the high hardness is maintained even after a sintering step. The alloy powder of the present invention is capable of actualizing hard particles for an abrasion-resistant iron-based sintered alloy, which can form a hard phase of which the high hardness is maintained even under conditions where the alloy powder is sintered at such a high temperature at which decomposition of a Cr-based carbide is promoted as described above, and which are totally different from conventional hard particles for an abrasion-resistant iron-based sintered alloy.

In contrast, adjustment of the components of a multicomponent alloy is relatively facilitated by producing the alloy by an atomization method such as a water atomization method or a gas atomization method, whereby particles of about 100 μm that are also excellent in productivity and are often used as a fine-particulate shot material for shot peening or hard particles for an abrasion-resistant iron-based sintered alloy can be efficiently obtained. However, when a large amount of Cr which is a high-melting point element is contained, the viscosity of a molten alloy metal is high and a nozzle is easily clogged from melting of raw materials to a spray step in the atomization method. In this regard, as a result of examining various additional trace elements as described in Examples later, the present inventors found that Mn is particularly effective at preventing a nozzle from clogging.

The restrictive reasons of the composition of the alloy powder of the present invention will be described below.

(1) C: 0.6% or More and 2.4% or Less

C is an essential component of the alloy powder of the present invention. The C content of the alloy powder of the present invention is adjusted to 0.6% or more and 2.4% or less. Therefore, the alloy powder has high hardness in a powdery state. In addition, when the alloy powder is used as hard particles for an abrasion-resistant iron-based sintered alloy (hard-phase forming powder), a hard phase of which the high hardness is maintained can be formed even if the alloy powder is held at high temperature in a sintering step. A C content of less than 0.6% may result in decreased hardness in a powdery state and in the decreased hardness of a hard phase in a sintered alloy, while a C content of more than 2.4% may allow both the hardnesses to be excessively high, resulting in embrittlement. Accordingly, the content of C is adjusted to 0.6% or more and 2.4% or less. The content of C is preferably more than 0.6% and less than 2.4%, and more preferably 1.0% or more and 2.3% or less.

(2) Cr: 36% or More and 60% or Less

Cr is an essential component of the alloy powder of the present invention. The Cr content of the alloy powder of the present invention is adjusted to 36% or more and 60% or less. Therefore, the alloy powder can exhibit high corrosion resistance when the alloy powder is used as a shot-peening shot material in a powdery state. In addition, when the alloy powder is used as hard particles for an abrasion-resistant iron-based sintered alloy (hard-phase forming powder), a hard phase of which the high hardness is maintained can be formed even if the alloy powder is held at high temperature in a sintering step. A Cr content of less than 36% may result in insufficient corrosion resistance in the case of using the alloy powder as a shot-peening shot material in a powdery state and in the decreased hardness of a hard phase in a sintered alloy in the case of using the alloy powder as hard particles for an abrasion-resistant iron-based sintered alloy (hard-phase forming powder). In contrast, a Cr content of more than 60% causes a nozzle to easily clog during atomization. Accordingly, the content of Cr is adjusted to 36% or more and 60% or less. The content of Cr is preferably 38% or more and 55% or less, and more preferably 40% or more and 50% or less.

(3) Mn: 0.1% or More and 10% or Less

Mn is an essential component of the alloy powder of the present invention. The Mn content of the alloy powder of the present invention is adjusted to 0.1% or more and 10% or less. Therefore, a nozzle can be inhibited from clogging in an atomization step. Mn also exhibits the effect of increasing hardness. A Mn content of less than 0.1% may result in the insufficient effect of inhibiting a nozzle from clogging, while a Mn content of more than 10% may result in the embrittlement of the powder and the embrittlement of a hard phase in a sintered alloy. Accordingly, the content of Mn is adjusted to 0.1% or more and 10% or less. The content of Mn is preferably 0.5% or more and 5% or less, and more preferably 1% or more and 3% or less.

(4) One or More Selected from Mo: 0% or More and 10% or Less, Si: 0% or More and Less than 2%, and Ni: 0% or More and 15% or Less Mo, Si and Ni are optional elements of the alloy powder of the present invention. It is preferable that the alloy powder of the present invention contains none of Mo, Si, and Ni from the viewpoint of a cost. However, the alloy powder of the present invention may contain one or more of Mo, Si, and Ni. The alloy powder of the present invention contains one or more of Mo, Si, and Ni, whereby hardness in a powdery state and the hardness of a hard phase in a sintered alloy can be increased. A Mo content of more than 10% results in saturation of the effect of Mo and in the impossibility of obtaining an effect corresponding to an increase in the content of Mo, and therefore causes a higher cost. A Si content of 2% or more may result in embrittlement in a powdery state and in embrittlement of a hard phase in a sintered alloy. A Ni content of more than 15% results in saturation of the effect of Ni and in the impossibility of obtaining an effect corresponding to an increase in the content of Ni, and therefore causes a higher cost. Accordingly, when the alloy powder of the present invention contains one or more of Mo, Si and Ni, the contents of the respective elements are Mo: 10% or less, Si: less than 2%, and Ni: 15% or less, preferably Mo: 0.1% or more and 7% or less, Si: 0.1% or more and 1.5% or less, and Ni: 0.1% or more and 7% or less, and more preferably Mo: 1% or more and 5% or less, Si: 0.5% or more and 1.0% or less, and Ni: 1% or more and 5% or less.

(5) One or More of Co: 0% or More and 5% or Less, W: 0% or More and 5% or Less, V: 0% or More and 5% or Less, and Nb: 0% or More and 5% or Less Co, W, V, and Nb are optional components of the alloy powder of the present invention. It is preferable that the alloy powder of the present invention contains none of Co, W, V, and Nb from the viewpoint of a cost. However, the alloy powder of the present invention may contain one or more of Co, W, V, and Nb. One or more of Co, W, V, and Nb can be added unless greatly influencing the properties of the alloy powder of the present invention. From the viewpoint of a cost, the contents of the respective elements are preferably Co: 5% or less, W: 5% or less, V: 5% or less, and Nb: 5% or less, and more preferably Co: 1% or less, W: 1% or less, V: 1% or less, and Nb: 1% or less, and none of the elements are still more preferably added. When the alloy powder of the present invention contains one or more of Co, W, V, and Nb, the contents of the respective elements are preferably Co: 0.1% or more, W: 0.1% or more, V: 0.1% or more, and Nb: 0.1% or more.

The average particle diameter (D50) of the alloy powder of the present invention is preferably 20 μm or more and 300 μm or less. When the average particle diameter (D50) of the alloy powder of the present invention is 20 μm or more and 300 μm or less, the alloy powder of the present invention can be preferably used as a shot-peening shot material or as a raw powder (hard-phase forming powder) for forming a hard phase in an iron-based sintered alloy. When the average particle diameter (D50) is less than 20 μm or more than 300 μm, yield and productivity due to an atomization method may be decreased. The average particle diameter (D50) of the alloy powder of the present invention is more preferably 30 μm or more and 250 μm or less and still more preferably 50 μm or more and 200 μm or less.

The average particle diameter (D50) of the alloy powder is a particle diameter at the point of a cumulative volume of 50% in a cumulative frequency distribution curve on a volumetric basis, determined based on a total volume of the alloy powder of 100%. The average particle diameter (D50) of the alloy powder can be measured by a laser diffraction scattering method. Examples of apparatuses suitable for such measurement include a laser diffraction/scattering-type particle size distribution measurement apparatus "MICROTRAC MT3000" from NIKKISO CO, LTD. In the apparatus, the alloy powder is poured with pure water into a cell, and the particle diameter of the alloy powder is detected based on the light scattering information of the alloy powder.

The Vickers hardness of the alloy powder of the present invention is preferably 500 HV or more. When the Vickers hardness of the alloy powder of the present invention is 500 HV or more, the alloy powder of the present invention can be preferably used as a shot-peening shot material or as a raw powder (hard-phase forming powder) for forming a hard phase in an iron-based sintered alloy. The Vickers hardness of the alloy powder of the present invention is more preferably 800 HV or more. The upper limit of the Vickers hardness is preferably 1200 and more preferably 1000.

The measurement of the Vickers hardness of the alloy powder is performed by measuring the Vickers hardness of a test sample produced by filling resin into the alloy powder and then polishing the alloy powder, using a microhardness tester "FM-700" from FUTURE-TECH CORP. Test force in the measurement of the Vickers hardness is set at 1.96 N. Examples of resins suitable for producing the test sample include thermosetting resin. Other conditions are in conformity with HS Z 2244: 2009.

[Shot Material for Shot Peening]

A shot-peening shot material of the present invention comprises the alloy powder of the present invention.

[Powder Metallurgical Composition]

A powder metallurgical composition of the present invention comprises an iron-based powder and the alloy powder of the present invention. The powder metallurgical composition of the present invention can be produced by mixing the iron-based powder, the alloy powder of the present invention, and optionally another powder (for example, graphite powder).

When an iron-based sintered alloy is formed by powder metallurgy using the powder metallurgical composition of the present invention, the iron-based matrix of the iron-based sintered alloy is formed of the iron-based powder. The amount of the iron-based powder contained in the powder metallurgical composition of the present invention can be adjusted as appropriate depending on molding conditions, sintering conditions, and the like used in the powder metallurgy, and is preferably 50 to 95 mass % and more preferably 60 to 90 mass % based on the total mass of the powder metallurgical composition of the present invention. Examples of the iron-based powder include pure iron powders, iron-based alloy powders, and mixed powders thereof. Examples of elements contained in the iron-based alloy powder include one or more of C, Mn, Si, Cr, Mo, V, Ti, Nb, Ni, and the like. These elements are effective at improving the thermal processability and the like of the iron-based sintered alloy and at increasing the hardness of the iron-based sintered alloy.

When the iron-based sintered alloy by the powder metallurgy using the powder metallurgical composition of the present invention is formed, a hard phase scattered (dispersed) in the iron-based matrix is formed by the alloy powder of the present invention. The hard phase formed in such a manner can improve the abrasion resistance of the iron-based sintered alloy. The amount of the alloy powder of the present invention contained in the powder metallurgical composition of the present invention can be adjusted as appropriate depending on the molding conditions, sintering conditions, and the like used in the powder metallurgy, and is preferably 5 to 50 mass % and more preferably 10 to 40 mass % based on the total mass of the powder metallurgical composition of the present invention. When the content of the alloy powder of the present invention is in the range described above, a hard phase effective at improving the abrasion resistance of the iron-based sintered alloy can be formed.

The powder metallurgical composition of the present invention may optionally comprise another component (component other than the iron-based powder and the alloy powder of the present invention). Examples of the other component include graphite powder, molybdenum disulfide, and calcium fluoride. When the powder metallurgical composition of the present invention comprises graphite powder, the content of the graphite powder is preferably 0.1 to 4 mass % and more preferably 0.5 to 3 mass % based on the total mass of the powder metallurgical composition of the present invention.

[Iron-Based Sintered Alloy]

The iron-based sintered alloy of the present invention is an iron-based sintered alloy obtained by sintering a molded body of the powder metallurgical composition of the present invention. The iron-based sintered alloy of the present invention comprises an iron-based matrix and a hard phase scattered (dispersed) in the iron-based matrix.

The iron-based sintered alloy of the present invention can be produced by powder metallurgy using a powder metallurgical composition of the present invention. When the iron-based sintered alloy is formed by the powder metallurgy using the powder metallurgical composition of the present invention, the iron-based matrix is formed of the iron-based powder, and the hard phase scattered in the iron-based matrix is formed of the alloy powder of the present invention. The hard phase formed in such a manner can improve the abrasion resistance of the iron-based sintered alloy.

The iron-based matrix preferably has a pearlite-containing structure in order to ensure the strength of the iron-based matrix. Examples of the pearlite-containing structure include a pearlite structure, a pearlite-austenite mixed structure, a pearlite-ferrite mixed structure, and a pearlite-cementite mixed structure. The content of ferrite having low strength is preferably allowed to be lower in order to ensure abrasion resistance. The amount of ferrite can be decreased by increasing the amount of graphite powder contained in the powder metallurgical composition.

The powder metallurgy using the powder metallurgical composition of the present invention can be carried out by a method comprising a step of performing compression-molding of the powder metallurgical composition of the present invention to form a molded body (hereinafter referred to as "molding step") and a step of sintering the molded body to form a sintered body (hereinafter referred to as "sintering step").

The molding step can be carried out by, for example, filling the powder metallurgical composition of the present invention into a metal mold and pressurizing the composition to form a powder molded body. A higher-fatty-acid-based lubricant may be applied to the inner surface of the metal mold before the powder metallurgical composition is filled into the metal mold. The higher-fatty-acid-based lubricant may be a higher fatty acid or a metal salt of the higher fatty acid. Examples of the higher fatty acid include stearic acid, palmitic acid, and oleic acid. Examples of the metal salt include a lithium salt, a calcium salt, and a zinc salt. Specific examples of the higher-fatty-acid-based lubricant include zinc stearate. The molding step can be carried out by a known molding method such as pressing. A molding pressure is typically 500 to 1000 MPa, and a molding temperature is typically room temperature.

The sintering step can be carried out by, for example, heating and sintering the powder molded body obtained in the molding step. A sintering temperature is typically 1000 to 1200° C., and a sintering time is typically 10 minutes to 2 hours. Sintered atmosphere is preferably antioxidant atmosphere such as vacuum atmosphere, inert gas atmosphere, or nitrogen atmosphere.

The Vickers hardness of the hard phase of the iron-based sintered alloy of the present invention is preferably 500 HV or more and more preferably 800 HV or more. The upper limit of the Vickers hardness is preferably 1200 and more preferably 1000.

The measurement of the Vickers hardness of the hard phase of the iron-based sintered alloy is performed by measuring the Vickers hardness of a test sample produced by filling resin into a cut piece (for example, semicircularly emery-cut piece) of the iron-based sintered alloy and then polishing a cut surface, using a microhardness tester "FM-700" from FUTURE-TECH CORP. Test force in the measurement of the Vickers hardness is set at 1.96 N. Examples of resins suitable for producing the test sample include thermosetting resin. Other conditions are in conformity with ES Z 2244: 2009.

EXAMPLES

The present invention will be specifically described below with reference to Examples.

[Production of Alloy Powder]

Molten raw materials adjusted to have compositions shown in Tables 1 to 4 were charged into a crucible made of alumina and was high-frequency melted in reduced-pressure argon atmosphere. The molten metal was tapped from a nozzle having a diameter of 5 mm in the lower portion of a crucible and was sprayed with high-pressure water or high-pressure nitrogen gas just after the tapping, to obtain water- or gas-atomized powders. The obtained atomized powders were classified into powders having predetermined particle sizes. Specifically, the atomized powders were classified into a powder having an average particle diameter (D50) of 10 μm using a sieve having an aperture of 20 μm, a powder having an average particle diameter (D50) of 20 μm using a sieve having an aperture of 38 μm, a powder having an average particle diameter (D50) of 40 μm using a sieve having an aperture of 75 μm, a powder having an average particle diameter (D50) of 50 μm using a sieve having an aperture of 106 μm, a powder having an average particle diameter (D50) of 80 μm using a sieve having an aperture of 150 μm, a powder having an average particle diameter (D50) of 100 μm using a sieve having an aperture of 210 μm, a powder having an average particle diameter (D50) of 150 μm using a sieve having an aperture of 300 μm, a powder having an average particle diameter (D50) of 200 μm using a sieve having an aperture of 355 μm, a powder having an average particle diameter (D50) of 250 μm using a sieve having an aperture of 500 μm, a powder having an average particle diameter (D50) of 300 μm using a sieve having an aperture of 600 μm, and a powder having an average particle diameter (D50) of 400 μm using a sieve having an aperture of 1000 μm. The following evaluations of the classified powders were conducted.

[Evaluation of State of Powder]

(1) Average Particle Diameter (D50)

The average particle diameters (D50) were determined based on particle size distributions measured by a laser diffraction scattering method using a laser diffraction/scattering-type particle size distribution measurement apparatus "MICROTRAC MT3000" from NIKKISO CO., LTD. In the measurement of the particle size distributions using MICROTRAC MT3000, each powder was poured with water (tap water) into the cell of this apparatus, and the diameters of the particles thereof were detected based on the light scattering information of the particles.

(2) Hardness

The Vickers hardness of a test sample produced by filling resin into each atomized powder and polishing the atomized powder was evaluated at a test force of 1.96 N using a microhardness tester "FM-700" from FUTURE-TECH CORP. Thermosetting resin was used for producing the test sample. A Vickers hardness of 800 HV or more was evaluated as "A", a Vickers hardness of 500 HV or more and less than 800 HV was evaluated as "B", a Vickers hardness of less than 500 HV was evaluated as "C".

(3) Brittleness

Shot peening was performed under the conditions of a projection pressure of 0.6 MPa and a projection time of 4 hours by a suction-air-type projection apparatus using the atomized powders as shot materials for shot peening and SKH 40 (HRC of 65) as a material to be treated. Into the projection apparatus, 20 kg of each shot material was put. The shot materials were circulated for a projection time of 4 hours and were used. Then, the brittleness evaluation of the shot materials collected from the projection apparatus was carried out as follows. Resin was filled into the collected shot materials, the shot materials were polished, the cross sections of the shot materials were observed with an optical microscope, and the brittleness thereof was evaluated based on the number of grains in which cracking occurred with respect to optional 30 grains. In other words, a case in which cracking occurred in 9 grains or less was evaluated as "A", a case in which cracking occurred in 10 grains or more and 19 grains or less was evaluated as "B", and a case in which cracking occurred in 20 grains or more was evaluated as "C".

(4) Corrosion Resistance

Into a beaker in which 1 L of tap water had been put, 100 g of each of the above-described shot materials collected after 1.0 the shot peening was put. The shot material was stirred for 1 minute and precipitated for 10 minutes. Supernatant liquid was removed, and the precipitate was naturally dried on a paper cloth for 24 hours. A case in which no rusting was seen was evaluated as "A", a case in which rusting partly remained was evaluated as "B", and a case in which rusting entirely occurred was evaluated as "C".

[Evaluation of State of Hard Phase in Iron-Based Sintered Alloy]

(1) Hardness

Each atomized powder, a reduced iron powder (average particle diameter of 50 μm), and a graphite powder were mixed at mass ratios of 20%, 79%, and 1%, respectively. Into a metal mold having a diameter of 20 mm, of which the inner surface was applied with zinc stearate, 5 g of this mixed powder was filled. The mixed powder was powder-compaction-molded at a molding pressure of 196 MPa between upper and lower punches. This molded body was sintered in a vacuum at 1150° C. to obtain a disc-shaped sintered body (iron-based sintered alloy) having a diameter of about 20 mm and a height of about 5 mm. In regard to a test sample produced by semicircularly emery-cutting the sintered body, filling resin into the sintered body, and polishing the cut surface thereof, the Vickers hardness of a hard phase in the iron-based sintered alloy was measured at a test force of 1.96 N using a microhardness tester "FM-700" from FUTURE-TECH CORP, Thermosetting resin was used for producing the test sample. The case of a Vickers hardness of 800 HV or more was evaluated as "A", the case of a Vickers hardness of 500 HV or more and less than 800 HV was evaluated as "B", and the case of a Vickers hardness of less than 500 HV was evaluated as "C".

(2) Brittleness

In the observation of the cut surface of the sintered body in the test sample described above with an optical microscope, cracks were seen in the hard phases becoming prominently brittle during emery-cutting or during polishing the cut surface. Thus, brittleness was evaluated based on the number of hard phases in which cracking occurred with respect to 30 optional granular hard phases. In other words, the case of zero hard phase was evaluated as "A", the case of one or more and four or less hard phases was evaluated as "B", and the case of five or more hard phases was evaluated as "C".

TABLE 1

| | Composition of Hard Powder (mass %) | | | | | | | | | | | Pro- | | | Properties of State of Powder | | | Properties of Hard Phase in Sintered Body | | |
|---|---|---|---|---|---|---|---|---|---|---|---|---|---|---|---|---|---|---|---|---|
| No. | C | Cr | Mn | Mo | Si | Ni | Co | W | V | Nb | Fe | duction Method | Clogging State | D50 μm | Hard-ness | Brittle-ness | Corrosion Resistance | Hard-ness | Brittle-ness | Remarks |
| 1 | 1.8 | 36 | 2 | 0 | 0 | 0 | 0 | 0 | 0 | 0 | Bal. | GA | A | 100 | B | A | B | B | A | Present |
| 2 | 1.5 | 38 | 0.1 | 0 | 0 | 0 | 0 | 0 | 0 | 0 | Bal. | WA | B | 150 | B | A | B | B | A | Invention |
| 3 | 2.1 | 40 | 5 | 0 | 0 | 0 | 0 | 0 | 0 | 0 | Bal. | GA | A | 40 | B | B | B | B | A | Examples |
| 4 | 2.3 | 42 | 0.5 | 0 | 0 | 0 | 0 | 0 | 0 | 0 | Bal. | GA | B | 80 | A | B | A | A | A | |
| 5 | 2.4 | 45 | 3 | 0 | 0 | 0 | 0 | 0 | 0 | 0 | Bal. | WA | A | 250 | A | B | A | A | B | |
| 6 | 0.8 | 48 | 4 | 0 | 0 | 0 | 0 | 0 | 0 | 0 | Bal. | WA | A | 20 | B | A | A | B | A | |
| 7 | 0.6 | 50 | 0.8 | 0 | 0 | 0 | 0 | 0 | 0 | 0 | Bal. | GA | A | 150 | B | A | A | A | A | |
| 8 | 1.2 | 54 | 10 | 0 | 0 | 0 | 0 | 0 | 0 | 0 | Bal. | GA | A | 50 | B | B | A | A | B | |
| 9 | 1.8 | 58 | 2 | 0 | 0 | 0 | 0 | 0 | 0 | 0 | Bal. | GA | B | 80 | B | A | A | A | A | |
| 10 | 1.8 | 60 | 2 | 0 | 0 | 0 | 0 | 0 | 0 | 0 | Bal. | WA | B | 100 | B | A | A | A | A | |
| 11 | 0.6 | 45 | 2 | 0 | 0 | 0 | 0 | 0 | 0 | 0 | Bal. | WA | A | 100 | B | A | A | B | A | |
| 12 | 0.7 | 42 | 0.8 | 0 | 0 | 0 | 0 | 0 | 0 | 0 | Bal. | WA | A | 80 | B | A | A | B | A | |

TABLE 1-continued

| No. | Composition of Hard Powder (mass %) C | Cr | Mn | Mo | Si | Ni | Co | W | V | Nb | Fe | Production Method | Clogging State | D50 μm | Properties of State of Powder Hardness | Brittleness | Corrosion Resistance | Properties of Hard Phase in Sintered Body Hardness | Brittleness | Remarks |
|---|---|---|---|---|---|---|---|---|---|---|---|---|---|---|---|---|---|---|---|---|
| 13 | 1 | 48 | 4 | 0 | 0 | 0 | 0 | 0 | 0 | 0 | Bal. | GA | A | 300 | B | A | A | B | A | |
| 14 | 1.3 | 54 | 0.1 | 0 | 0 | 0 | 0 | 0 | 0 | 0 | Bal. | GA | B | 80 | B | A | A | A | A | |
| 15 | 1.6 | 60 | 1 | 0 | 0 | 0 | 0 | 0 | 0 | 0 | Bal. | GA | B | 250 | B | A | A | A | A | |
| 16 | 1.9 | 36 | 3 | 0 | 0 | 0 | 0 | 0 | 0 | 0 | Bal. | WA | A | 40 | B | A | B | B | A | |
| 17 | 2.1 | 40 | 10 | 0 | 0 | 0 | 0 | 0 | 0 | 0 | Bal. | GA | A | 150 | B | B | B | B | B | |
| 18 | 2.3 | 42 | 0.8 | 0 | 0 | 0 | 0 | 0 | 0 | 0 | Bal. | GA | A | 150 | A | B | A | A | A | |
| 19 | 2.4 | 45 | 2 | 0 | 0 | 0 | 0 | 0 | 0 | 0 | Bal. | WA | A | 100 | A | B | A | A | B | |
| 20 | 1.8 | 45 | 0.1 | 0 | 0 | 0 | 0 | 0 | 0 | 0 | Bal. | WA | B | 100 | B | A | A | B | A | |

NOTE 1:
Production Method: WA: Water atomization method, GA: Gas atomization method
NOTE 2:
Clogging State: A: No clogging of nozzle, B: Clogging of nozzle just before end of atomization, C: Clogging of nozzle just after start of atomization

TABLE 2

| No. | Composition of Hard Powder (mass %) C | Cr | Mn | Mo | Si | Ni | Co | W | V | Nb | Fe | Production Method | Clogging State | D50 μm | Properties of State of Powder Hardness | Brittleness | Corrosion Resistance | Properties of Hard Phase in Sintered Body Hardness | Brittleness | Remarks |
|---|---|---|---|---|---|---|---|---|---|---|---|---|---|---|---|---|---|---|---|---|
| 21 | 2.1 | 54 | 0.3 | 0 | 0 | 0 | 0 | 0 | 0 | 0 | Bal. | GA | B | 80 | B | A | A | A | A | Present |
| 22 | 1.6 | 40 | 0.6 | 0 | 0 | 0 | 0 | 0 | 0 | 0 | Bal. | GA | A | 20 | B | A | B | B | A | Invention |
| 23 | 2.3 | 60 | 0.8 | 0 | 0 | 0 | 0 | 0 | 0 | 0 | Bal. | GA | B | 80 | A | B | A | A | A | Examples |
| 24 | 0.6 | 42 | 1 | 0 | 0 | 0 | 0 | 0 | 0 | 0 | Bal. | WA | A | 200 | B | A | A | B | A | |
| 25 | 0.8 | 36 | 2 | 0 | 0 | 0 | 0 | 0 | 0 | 0 | Bal. | WA | A | 250 | B | A | B | B | A | |
| 26 | 2.4 | 48 | 4 | 0 | 0 | 0 | 0 | 0 | 0 | 0 | Bal. | WA | A | 150 | A | B | A | A | B | |
| 27 | 1.9 | 42 | 6 | 0 | 0 | 0 | 0 | 0 | 0 | 0 | Bal. | GA | A | 300 | B | B | A | B | B | |
| 28 | 1.5 | 48 | 8 | 0 | 0 | 0 | 0 | 0 | 0 | 0 | Bal. | GA | A | 40 | B | B | A | B | B | |
| 29 | 1.8 | 45 | 10 | 0 | 0 | 0 | 0 | 0 | 0 | 0 | Bal. | GA | A | 100 | B | B | A | B | B | |
| 30 | 1 | 45 | 4 | 0.1 | 0 | 0 | 0 | 0 | 0 | 0 | Bal. | GA | A | 250 | B | A | A | B | A | |
| 31 | 1.8 | 40 | 2 | 1 | 0 | 0 | 0 | 0 | 0 | 0 | Bal. | GA | A | 100 | B | A | B | B | A | |
| 32 | 2.3 | 54 | 2 | 3 | 0.7 | 0 | 0 | 0 | 0 | 0 | Bal. | GA | A | 300 | A | B | A | A | A | |
| 33 | 1.2 | 45 | 1 | 5 | 0 | 0 | 0 | 0 | 0 | 0 | Bal. | WA | A | 250 | A | B | B | A | A | |
| 34 | 2.3 | 40 | 2 | 7 | 0 | 0 | 0 | 0 | 0 | 0 | Bal. | WA | A | 80 | A | B | B | A | A | |
| 35 | 2.3 | 42 | 0.5 | 0 | 0 | 0 | 0 | 0 | 0 | 0 | Bal. | GA | B | 80 | A | B | A | A | A | |
| 36 | 2.1 | 45 | 0.1 | 0 | 0.1 | 0 | 0 | 0 | 0 | 0 | Bal. | WA | B | 100 | B | A | A | B | A | |
| 37 | 1.8 | 36 | 2 | 0 | 0.5 | 0 | 0 | 0 | 0 | 0 | Bal. | WA | A | 100 | B | A | B | B | A | |
| 38 | 1 | 48 | 2 | 0 | 0.7 | 3 | 0 | 0 | 0 | 0 | Bal. | GA | A | 80 | B | A | A | B | A | |
| 39 | 2.3 | 45 | 1 | 0 | 1 | 0 | 0 | 0 | 0 | 0 | Bal. | WA | A | 20 | A | B | A | A | A | |
| 40 | 1.8 | 38 | 2 | 0 | 1.5 | 0 | 0 | 0 | 0 | 0 | Bal. | WA | A | 250 | A | A | B | B | A | |

NOTE 1:
Production Method: WA: Water atomization method, GA: Gas atomization method
NOTE 2:
Clogging State: A: No clogging of nozzle, B: Clogging of nozzle just before end of atomization, C: Clogging of nozzle just after start of atomization

TABLE 3

| No. | Composition of Hard Powder (mass %) C | Cr | Mn | Mo | Si | Ni | Co | W | V | Nb | Fe | Production Method | Clogging State | D50 μm | Properties of State of Powder Hardness | Brittleness | Corrosion Resistance | Properties of Hard Phase in Sintered Body Hardness | Brittleness | Remarks |
|---|---|---|---|---|---|---|---|---|---|---|---|---|---|---|---|---|---|---|---|---|
| 41 | 2.1 | 40 | 2 | 0 | 0 | 0 | 0 | 0 | 0 | 0 | Bal. | GA | A | 100 | B | A | B | B | A | Present |
| 42 | 1.8 | 42 | 8 | 0 | 0 | 0.1 | 0 | 0 | 0 | 0 | Bal. | WA | A | 100 | B | B | A | B | B | Invention |
| 43 | 1.2 | 45 | 0.5 | 0 | 0 | 1 | 0 | 0 | 0 | 0 | Bal. | WA | B | 80 | B | A | A | B | A | Examples |
| 44 | 2.3 | 48 | 1 | 3 | 0 | 3 | 0 | 0 | 0 | 0 | Bal. | WA | A | 80 | A | B | A | A | A | |
| 45 | 2.1 | 38 | 2 | 0 | 0 | 5 | 0 | 0 | 0 | 0 | Bal. | GA | A | 300 | A | A | B | B | A | |
| 46 | 1.8 | 38 | 2 | 0 | 0 | 7 | 0 | 0 | 0 | 0 | Bal. | GA | A | 150 | A | A | B | B | A | |
| 47 | 1.8 | 60 | 2 | 3 | 0.7 | 3 | 0 | 0 | 0 | 0 | Bal. | GA | B | 150 | B | A | A | A | A | |
| 48 | 0.6 | 54 | 2 | 0 | 0 | 0 | 0.5 | 0.5 | 0 | 0 | Bal. | GA | A | 40 | B | A | A | B | A | |
| 49 | 1 | 48 | 2 | 3 | 0 | 0 | 1 | 0 | 0 | 0 | Bal. | GA | A | 100 | B | A | A | B | A | |

TABLE 3-continued

| No. | Composition of Hard Powder (mass %) C | Cr | Mn | Mo | Si | Ni | Co | W | V | Nb | Fe | Production Method | Clogging State | D50 μm | Properties of State of Powder: Hardness | Brittleness | Corrosion Resistance | Properties of Hard Phase in Sintered Body: Hardness | Brittleness | Remarks |
|---|---|---|---|---|---|---|---|---|---|---|---|---|---|---|---|---|---|---|---|---|
| 50 | 2.4 | 45 | 1 | 0 | 0 | 0 | 0 | 0.5 | 0.5 | 0 | Bal. | GA | A | 150 | A | B | A | A | B | |
| 51 | 2.3 | 38 | 2 | 0 | 0.7 | 0 | 0 | 1 | 0 | 0 | Bal. | GA | A | 250 | A | B | B | B | A | |
| 52 | 1 | 54 | 0.5 | 0 | 0 | 0 | 0 | 0 | 0.5 | 0.5 | Bal. | WA | B | 80 | B | A | A | B | A | |
| 53 | 1.2 | 45 | 10 | 0 | 0 | 3 | 0 | 0 | 1 | 0 | Bal. | GA | A | 100 | B | B | A | B | B | |
| 54 | 2.1 | 40 | 2 | 0 | 0 | 0 | 0.5 | 0 | 0 | 0.5 | Bal. | GA | A | 20 | B | A | B | B | A | |
| 55 | 1.8 | 38 | 4 | 3 | 0.7 | 3 | 0 | 0 | 0 | 1 | Bal. | GA | A | 250 | A | A | B | B | A | |
| 56 | 2.3 | 42 | 2 | 3 | 0.7 | 3 | 0.5 | 0.5 | 0.5 | 0.5 | Bal. | WA | A | 80 | A | B | A | A | A | |
| 57 | 1.8 | 42 | 2 | 10 | 0 | 0 | 0 | 0 | 0 | 0 | Bal. | GA | A | 150 | A | A | A | B | A | |
| 58 | 2.1 | 45 | 1 | 0 | 0 | 15 | 0 | 0 | 0 | 0 | Bal. | WA | A | 100 | A | A | A | B | A | |
| 59 | 1 | 40 | 2 | 0 | 0 | 0 | 5 | 0 | 0 | 0 | Bal. | GA | A | 150 | B | A | B | B | A | |
| 60 | 1 | 54 | 6 | 0 | 0 | 0 | 0 | 5 | 0 | 0 | Bal. | GA | A | 100 | B | B | A | B | B | |
| 61 | 2.3 | 48 | 2 | 0 | 0 | 0 | 0 | 0 | 5 | 0 | Bal. | WA | A | 80 | A | B | A | A | A | |
| 62 | 1 | 40 | 4 | 0 | 0 | 0 | 0 | 0 | 0 | 5 | Bal. | GA | A | 80 | B | A | B | B | A | |

NOTE 1:
Production Method: WA: Water atomization method, GA: Gas atomization method
NOTE 2:
Clogging State: A: No clogging of nozzle, B: Clogging of nozzle just before end of atomization, C: Clogging of nozzle just after start of atomization

TABLE 4

| No. | Composition of Hard Powder (mass %) C | Cr | Mn | Mo | Si | Ni | Co | W | V | Nb | Fe | Production Method | Clogging State | D50 μm | Properties of State of Powder: Hardness | Brittleness | Corrosion Resistance | Properties of Hard Phase in Sintered Body: Hardness | Brittleness | Remarks |
|---|---|---|---|---|---|---|---|---|---|---|---|---|---|---|---|---|---|---|---|---|
| 63 | 1.8 | 25 | 2 | 0 | 0 | 0 | 0 | 0 | 0 | 0 | Bal. | GA | A | 100 | B | A | C | C | A | Comparative Examples |
| 64 | 1.8 | 30 | 2 | 0 | 0 | 0 | 0 | 0 | 0 | 0 | Bal. | GA | A | 100 | B | A | C | C | A | |
| 65 | 1.8 | 32 | 2 | 0 | 0 | 0 | 0 | 0 | 0 | 0 | Bal. | GA | A | 100 | B | A | C | C | A | |
| 66 | 1.8 | 34 | 2 | 0 | 0 | 0 | 0 | 0 | 0 | 0 | Bal. | GA | A | 100 | B | A | C | C | A | |
| 67 | 1.8 | 62 | 2 | 0 | 0 | 0 | 0 | 0 | 0 | 0 | Bal. | WA | C | 100 | B | A | A | A | C | |
| 68 | 1.8 | 65 | 2 | 0 | 0 | 0 | 0 | 0 | 0 | 0 | Bal. | WA | C | 100 | B | A | A | A | C | |
| 69 | 0 | 45 | 2 | 0 | 0 | 0 | 0 | 0 | 0 | 0 | Bal. | WA | A | 100 | C | A | A | C | A | |
| 70 | 0.5 | 45 | 2 | 0 | 0 | 0 | 0 | 0 | 0 | 0 | Bal. | WA | A | 100 | C | A | A | C | A | |
| 71 | 2.5 | 45 | 2 | 0 | 0 | 0 | 0 | 0 | 0 | 0 | Bal. | WA | A | 100 | A | C | A | A | C | |
| 72 | 2.7 | 45 | 2 | 0 | 0 | 0 | 0 | 0 | 0 | 0 | Bal. | WA | A | 100 | A | C | A | A | C | |
| 73 | 3 | 45 | 2 | 0 | 0 | 0 | 0 | 0 | 0 | 0 | Bal. | WA | A | 100 | A | C | A | A | C | |
| 74 | 1.8 | 45 | 0 | 0 | 0 | 0 | 0 | 0 | 0 | 0 | Bal. | WA | C | 100 | B | A | A | B | A | |
| 75 | 1.8 | 45 | 0.05 | 0 | 0 | 0 | 0 | 0 | 0 | 0 | Bal. | WA | C | 100 | B | A | A | B | A | |
| 76 | 1.8 | 45 | 12 | 0 | 0 | 0 | 0 | 0 | 0 | 0 | Bal. | GA | A | 100 | B | C | A | B | C | |
| 77 | 1.8 | 45 | 14 | 0 | 0 | 0 | 0 | 0 | 0 | 0 | Bal. | GA | A | 100 | B | C | A | B | C | |
| 78 | 2.3 | 42 | 2 | 0 | 2 | 0 | 0 | 0 | 0 | 0 | Bal. | GA | A | 80 | A | C | A | A | C | |

NOTE 1:
The underlined figures fall outside the scope of the present invention.
NOTE 2:
Production Method: WA: Water atomization method, GA: Gas atomization method
NOTE 3:
Clogging State: A: No clogging of nozzle, B: Clogging of nozzle just before end of atomization, C: Clogging of nozzle just after start of atomization Nos. 1 to 62 shown in Tables 1 to 3 are present invention examples, while Nos. 63 to 78 shown in Table 4 are comparative examples.

Comparative Example Nos. 63 to 66 in Table 4 result in poor corrosion resistance in the case of being used as a shot material for shot peening in a powdery state and in poor hardness in the case of being used as hard particles for an iron-based sintered alloy (hard-phase forming powder) because of having a Cr content of less than 36%. Comparative Example Nos. 67 and 68 result in clogging of a nozzle just after start of atomization and in a brittle hard phase in an iron-based sintered alloy because of having a Cr content of more than 60%. Comparative Example Nos. 69 and 70 result in poor hardness in the case of being used as a shot material for shot peening in a powdery state and in poor hardness in the case of being used as hard particles for an iron-based sintered alloy (hard-phase forming powder) because of having a C content of less than 0.6%.

Comparative Example Nos. 71 to 73 result in brittleness in the case of being used as a shot material for shot peening in a powdery state and in the case of being used as hard particles for an iron-based sintered alloy (hard-phase forming powder) because of having a C content of more than 2.4%. Comparative Example Nos. 74 and 75 resulted in clogging of a nozzle just after start of atomization because of having a Mn content of less than 0.1%. Comparative Example Nos. 76 and 77 result in brittleness in the case of being used as a shot material for shot peening in a powdery state and in the case of being used as hard particles for an iron-based antifriction sintered alloy (hard-phase forming powder) because of having a Mn content of more than 10%.

Comparative Example No. 78 results in brittleness in the case of being used as a shot material for shot peening in a powdery state and in the case of being used as hard particles for an iron-based antifriction sintered alloy (hard-phase forming powder) because of having a high Si content.

In contrast, all of the present invention examples shown in Tables 1 to 3 are excellent in all of hardness, brittleness, and corrosion resistance because of having a C content of 0.6% or more and 2.4% or less, a Cr content of 36% or more and 60% or less, and a Mn content of 0.1% or more and 10% or less. However, Present Invention Example No. 57 results in a higher cost because of having a high Mo content although being excellent in the various properties. Further, all of Present Invention Example Nos. 58 to 62 result in higher costs because of having the high contents of rare metals (Ni, Co, W, V, and Nb) although being excellent in the various properties.

Present Invention Example Nos. 6, 22, 39, and 54 were classified into D50=20 μm using a sieve having an aperture of 38 μm and were evaluated. All of the yields of these powders in the case of classifying the powders into D50=10 μm using a sieve having an aperture of 20 μm were ⅕ or less of those in the case of classifying the powders into D50=20 μm using a sieve having an aperture of 38 μm. Thus, Present Invention Example Nos. 6, 22, 39, and 54 resulted in very low productivity. Further, Present Invention Example Nos. 13, 27, 32, and 45 were classified into D50=300 μm using a sieve having an aperture of 600 μm and were evaluated. All of the yields of these powders in the case of classifying the powders into D50=400 μm using a sieve having an aperture of 1000 μm were ⅕ or less of those in the case of classifying the powders into D50=300 μm using a sieve having an aperture of 600 μm. Thus, Present Invention Example Nos. 13, 27, 32, and 45 resulted in very low productivity.

As described above, use of the alloy powder of the present invention as a shot material for shot peening results in high-Cr composition, thereby enabling obtainment of a passive film that endures damage to a passive film due to a collision with a material to be treated as well as deterioration in corrosion resistance due to introduction of a very high lattice defect into the shot material due to a collision with the material to be treated. Further, use of the alloy powder of the present invention as hard particles for an abrasion-resistant iron-based sintered alloy (hard-phase forming powder) results in formation of a Cr-based carbide having high Cr concentration and excellent high-temperature stability, whereby the carbide can be inhibited from disappearing during high-temperature sintering, and moreover, the atomization property of such high-Cr composition having a high melting point can be improved by adding a slight amount of Mn. Accordingly, the present invention can provide a hard powder that has high productivity and high corrosion resistance and can be produced from inexpensive raw materials, as well as a shot material for shot peening, a powder metallurgical composition, and an abrasion-resistant iron-based sintered alloy in which hard particles are dispersed.

The invention claimed is:

1. A shot material for shot peening comprising an alloy powder, comprising, in mass %, C: 0.6% or more and 2.4% or less,
Cr: 36% or more and 60% or less,
Mn: 0.1% or more and 10% or less,
Mo: 0% or more and 10% or less,
Si: 0% or more and less than 2%,
Ni: 0% or more and 15% or less,
Co: 0% or more and 5% or less,
W: 0% or more and 5% or less,
V: 0% or more and 5% or less,
Nb: 0% or more and 5% or less, and
a balance of Fe and unavoidable impurities,
wherein the alloy powder has an average particle diameter (D50) of 20 to 300 μm.

2. The shot material according to claim 1, comprising, in mass %, one or more selected from Mo: 0.1% or more and 10% or less, Si: 0.1% or more and less than 2%, and Ni: 0.1% or more and 15% or less.

3. The shot material according to claim 1, comprising, in mass %, one or more selected from Co: 0.1% or more and 5% or less, W: 0.1% or more and 5% or less, V: 0.1% or more and 5% or less, and Nb: 0.1% or more and 5% or less.

4. The shot material according to claim 1, comprising, in mass %, one or more selected from Mo: 0.1% or more and 10% or less, Si: 0.1% or more and less than 2%, and Ni: 0.1% or more and 15% or less, and one or more selected from Co: 0.1% or more and 5% or less, W: 0.1% or more and 5% or less, V: 0.1% or more and 5% or less, and Nb: 0.1% or more and 5% or less.

5. The shot material according to claim 1, wherein the alloy powder has a Vickers hardness of 500 HV or more.

6. The shot material according to claim 1, wherein the alloy powder has an average particle diameter (D50) of 20 to 300 μm and a Vickers hardness of 500 HV or more.

7. A hard-phase forming powder for an abrasion-resistant iron-based sintered alloy, comprising, in mass %, C: 0.6% or more and 2.4% or less,
Cr: 36% or more and 60% or less,
Mn: 0.5% or more and 10% or less,
Mo: 0% or more and 10% or less,
Si: 0% or more and less than 2%,
Ni: 0% or more and 15% or less,
Co: 0% or more and 5% or less,
W: 0% or more and 5% or less,
V: 0% or more and 5% or less,
Nb: 0% or more and 5% or less, and
a balance of Fe and unavoidable impurities.

8. The hard-phase forming powder according to claim 7, comprising, in mass %, one or more selected from Mo: 0.1% or more and 10% or less, Si: 0.1% or more and less than 2%, and Ni: 0.1% or more and 15% or less.

9. The hard-phase forming powder according to claim 7, comprising, in mass %, one or more selected from Co: 0.1% or more and 5% or less, W: 0.1% or more and 5% or less, V: 0.1% or more and 5% or less, and Nb: 0.1% or more and 5% or less.

10. The hard-phase forming powder according to claim 7, comprising, in mass %, one or more selected from Mo: 0.1% or more and 10% or less, Si: 0.1% or more and less than 2%, and Ni: 0.1% or more and 15% or less, and one or more selected from Co: 0.1% or more and 5% or less, W: 0.1% or more and 5% or less, V: 0.1% or more and 5% or less, and Nb: 0.1% or more and 5% or less.

11. The hard-phase forming powder according to claim 7, wherein the powder has an average particle diameter (D50) of 20 to 300 μm.

12. The hard-phase forming powder according to claim 7, wherein the powder has a Vickers hardness of 500 HV or more.

13. The hard-phase forming powder according to claim 7, wherein the powder has an average particle diameter (D50) of 20 to 300 μm and a Vickers hardness of 500 HV or more.

14. An abrasion-resistant iron-based sintered alloy, wherein the hard-phase forming powder according to claim 7 is dispersed and sintered in an iron-based alloy substrate.

* * * * *